US008616017B2

(12) United States Patent
Shimazu et al.

(10) Patent No.: US 8,616,017 B2
(45) Date of Patent: Dec. 31, 2013

(54) AIR CONDITIONING APPARATUS

(75) Inventors: Yusuke Shimazu, Chiyoda-ku (JP); Keisuke Takayama, Chiyoda-ku (JP); Koji Yamashita, Chiyoda-ku (JP); Hiroyuki Morimoto, Chiyoda-ku (JP); Shinichi Wakamoto, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 190 days.

(21) Appl. No.: 13/263,607

(22) PCT Filed: May 8, 2009

(86) PCT No.: PCT/JP2009/058663

§ 371 (c)(1),
(2), (4) Date: Oct. 7, 2011

(87) PCT Pub. No.: WO2010/128551

PCT Pub. Date: Nov. 11, 2010

(65) Prior Publication Data

US 2012/0043056 A1 Feb. 23, 2012

(51) Int. Cl.
*F25B 7/00* (2006.01)

(52) U.S. Cl.
USPC ..... 62/335; 62/513

(58) Field of Classification Search
USPC ..... 62/335, 80, 234, 151, 238.7, 324.1, 62/160, 513; 165/58, 96
See application file for complete search history.

(56) References Cited

U.S. PATENT DOCUMENTS 4,648,247 A * 3/1987 Takizawa et al. ..... 62/256
5,729,985 A * 3/1998 Yoshihara et al. ..... 62/81
5,761,921 A * 6/1998 Hori et al. ..... 62/238.4
5,783,243 A * 7/1998 Benado ..... 426/425

(Continued)

FOREIGN PATENT DOCUMENTS

JP 59-002832 B2 1/1984
JP 4-006369 A 1/1992

(Continued)

OTHER PUBLICATIONS

International Search Report (PCT/ISA/210) issued on Jul. 28, 2009, by Japanese Patent Office as the International Searching Authority for International Application No. PCT/JP2009/058663.
First Office Action issued on Aug. 16, 2013, by the Chinese Patent Office in corresponding Chinese Patent Application No. 200980159162.7, and an English Translation of the Office Action. (7 pages).

*Primary Examiner* — Mohammad M Ali
(74) *Attorney, Agent, or Firm* — Buchanan Ingersoll & Rooney PC

(57) ABSTRACT

A first cycle, in which a first medium is circulated, employs a compressor, a first heat exchanger structured with an air heat exchanger, a second heat exchanger, and a third heat exchanger. A second cycle, in which a second medium is circulated and heat is exchanged with the first medium through the second heat exchanger, employs indoor units, each having a fan. A third cycle, in which the second medium is circulated and heat is exchanged with the first medium through the third heat exchanger, shares the indoor units with the second cycle. Flow path switching valves switch flow paths between the second cycle and third cycle. Before the first heat exchanger is defrosted, a halted indoor unit is filled with the second medium in the third cycle with its fan being halted. The third heat exchanger functions as an evaporator during a defrosting operation.

7 Claims, 10 Drawing Sheets

(56) References Cited

U.S. PATENT DOCUMENTS

| | | | | |
|---|---|---|---|---|
| 6,536,518 | B2 * | 3/2003 | Trieskey | 165/240 |
| 6,823,683 | B2 * | 11/2004 | Amaral et al. | 62/159 |
| 6,862,892 | B1 * | 3/2005 | Meyer et al. | 62/115 |
| 2002/0012740 | A1 * | 1/2002 | Benado | 426/632 |
| 2005/0183452 | A1 * | 8/2005 | Hahn et al. | 62/620 |
| 2007/0056318 | A1 * | 3/2007 | Ransbarger | 62/611 |
| 2007/0113584 | A1 * | 5/2007 | Eaton et al. | 62/613 |
| 2008/0022716 | A1 * | 1/2008 | Eaton et al. | 62/612 |

FOREIGN PATENT DOCUMENTS

| | | | |
|---|---|---|---|
| JP | 8-049936 | A | 2/1996 |
| JP | 11-344240 | A | 12/1999 |
| JP | 2005-337659 | A | 12/2005 |

* cited by examiner

AIR CONDITIONING APPARATUS

TECHNICAL FIELD

The present invention relates to an air conditioning apparatus that can efficiently remove frost from an air heat exchanger that is formed when heating energy is generated from a heat source.

BACKGROUND ART

One known type of a conventional air conditioning apparatus exchanges heat between a refrigerant-side cycle (primary cycle) and a water-side cycle (secondary cycle) and collects condensation heat generated during cooling operation so that heating and cooling can be performed simultaneously.

If heating only operation is performed or if a heating capacity is larger than cooling capacity in the cooling heating simultaneous operation, when an ambient temperature is low, frost is formed on the air heat exchanger. The defrosting capacity for removing the frost is basically determined on the basis of electricity supplied to the compressor. Defrosting operation has been performed under the cooling heating simultaneous operation so as to use neat absorbed from a cooling load as a heat source to increase the defrosting capacity (see PTL 1, or example).

CITATION LIST

Patent Literature

PTL 1: Japanese Examined Patent Application Publication No. 59-2632 (page 4, FIGS. 5 and 6)

SUMMARY OF INVENTION

Technical Problem

As described above, defrosting operation has been performed during the cooling heating simultaneous operation so as to use heat absorbed from a cooling load as a heat source to increase the defrosting capacity, in other words, conventional techniques can be used to increase the defrosting capacity only in the cooling heating simultaneous operation, during which only a relatively small amount of frost is formed. That is, it has not been possible to increase the defrosting capacity when heating only operation, during which a relatively large amount of frost is formed, is performed. Furthermore, the water-side cycle (secondary cycle), in which heat is exchanged with the refrigerant, has not bee considered.

A technical object of the present invention is to increase a defrosting capacity for an it heat exchanger and thereby to shorten a defrosting time and improve operation efficiency.

Solution to Problem

An air conditioning apparatus according to the present invention includes a first cycle in which a first medium is circulated, a second cycle in which a second medium is circulated, and a third cycle in which the second medium is circulated; the first cycle is formed by connecting a compressor, a first heat exchanger constituted by an air heat exchanger, a first decompression valve, a second eat exchanger that exchanges heat between the first cycle and the second cycle, a second decompression valve, a third heat exchanger that exchanges heat between the first cycle and the third cycle, and a four-way valve that switches the flow direction of the first medium between a forward direction and a reverse direction, in that order; the second cycle is formed by connecting the second heat exchanger, first pump that drives the second medium, a first branching path that branches a single path into a plurality of paths, indoor units, each of which has a fan, and a first merging path that merges a plurality of paths into a single path, in that order; the third cycle is formed by connecting the third heat exchanger, a second pump that drives the second medium, a second branching path that branches a single path into a plurality of paths, flow rate adjusting valves, the indoor units, and a second merging path that merges a plurality of paths into a single path, in that order: a first flow path switching valve is provided with each path branched by each branching path, the first flow path switching valve being capable of switching a flow path between the second cycle and the third cycle; a second flow path switching valve is provided with each path merged by each merging path, the second flow path switching valve being capable of switching a flow path between the second cycle and the third cycle; the indoor units and the flow rate adjusting valves select the second cycle or the third cycle; when the indoor units perform only heating operation or cooling heating simultaneous operation in which heating capacity is larger than cooling capacity, and when the first heat exchanger is defrosted, the first path switching valve and second flow path switching valve on the side of a halted indoor unit are switched to the third cycle side and the second pump is driven.

Advantageous Effects of invention

According to the present invention, not Only a compressor but also a second Medium are used as a heat source, so a defrosting time can be reduced and highly efficient operation can be thereby achieved.

DESCRIPTION OF EMBODIMENTS

Figure 1:
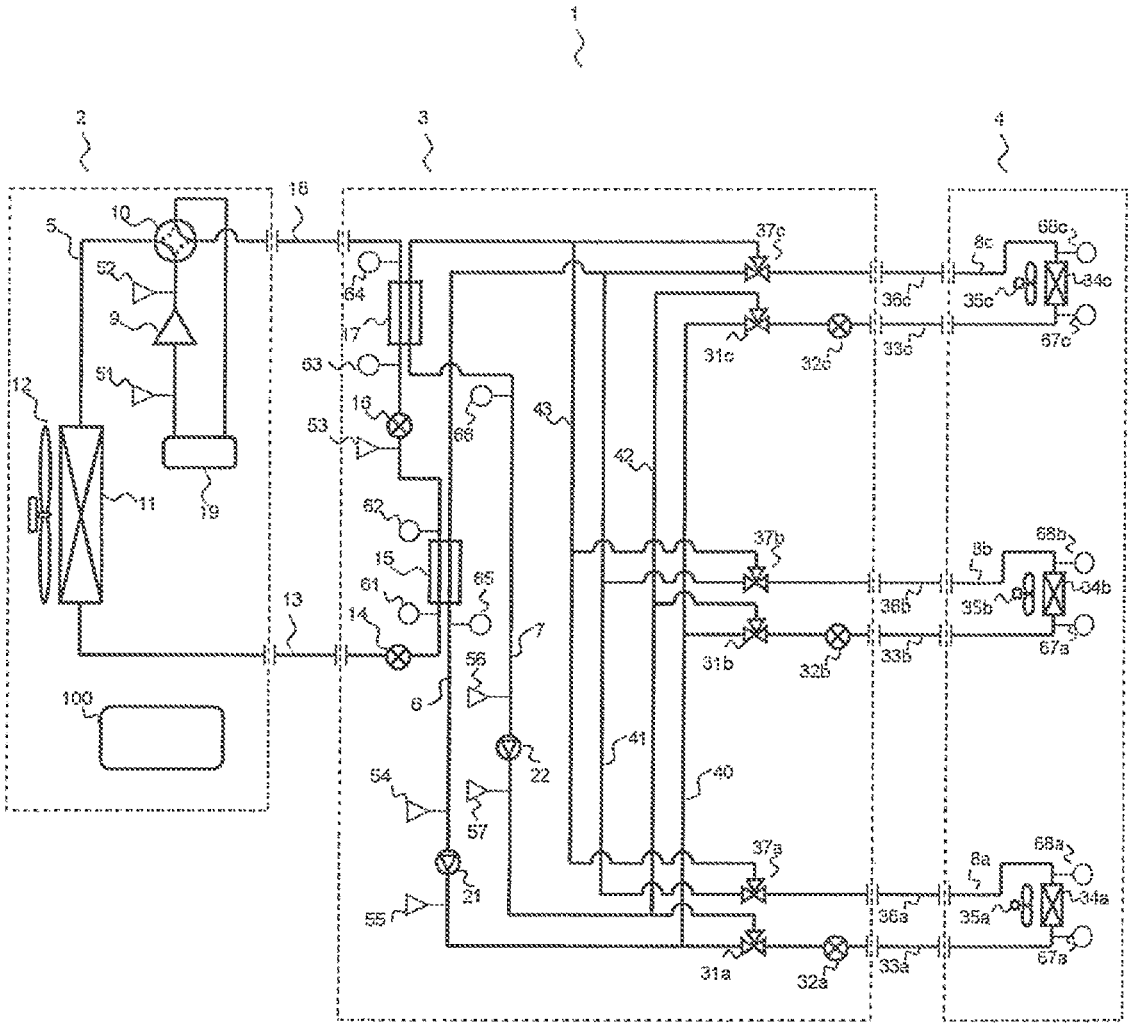
FIG. 1 is a circuit diagram showing the structure of an air conditioning apparatus according to an embodiment of the present invention.
Figure 2:
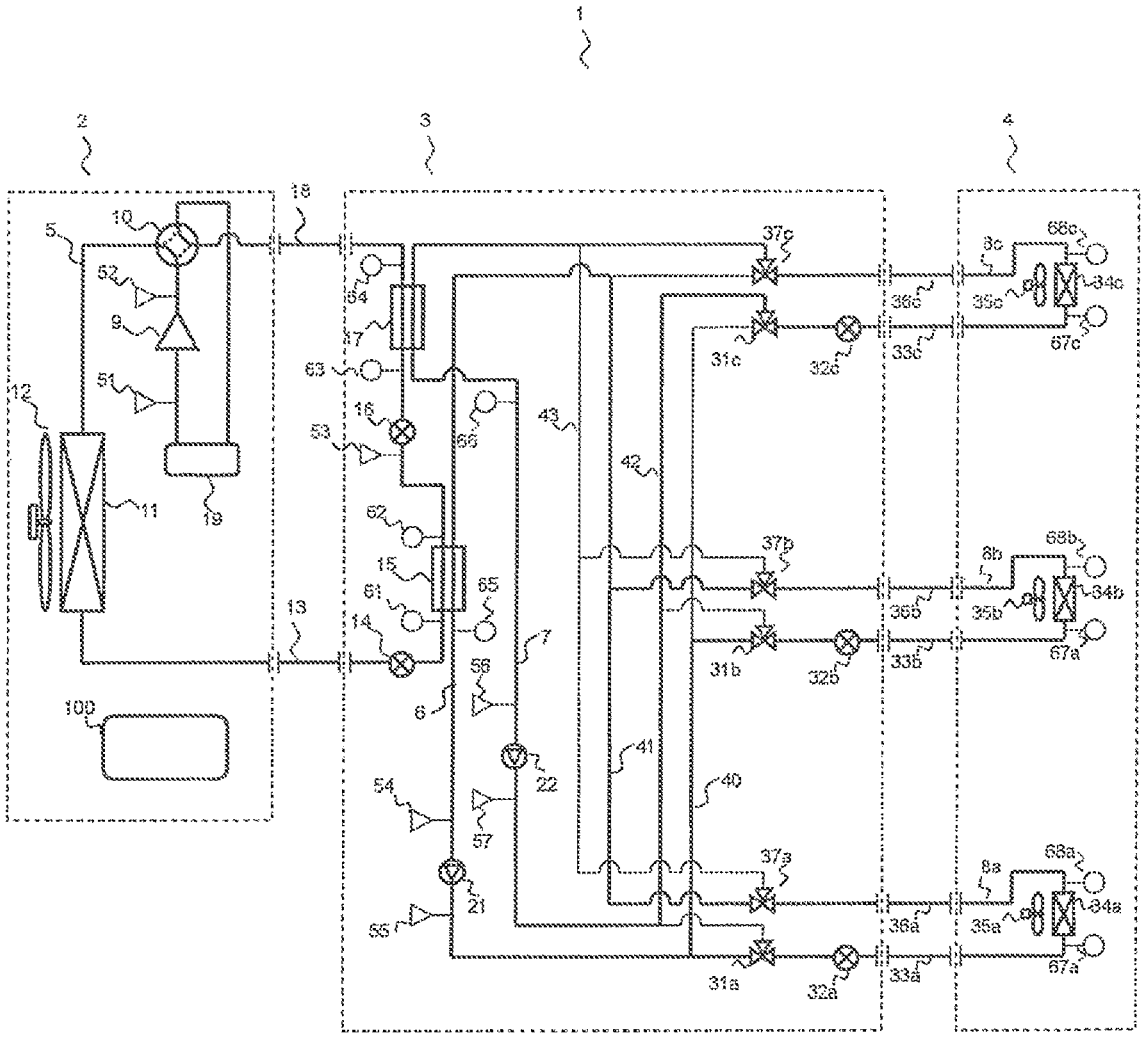
FIG. 2 is a circuit diagram related to an operation in which the air conditioning apparatus according to the embodiment of the present invention performs cooling only operation.
Figure 3:
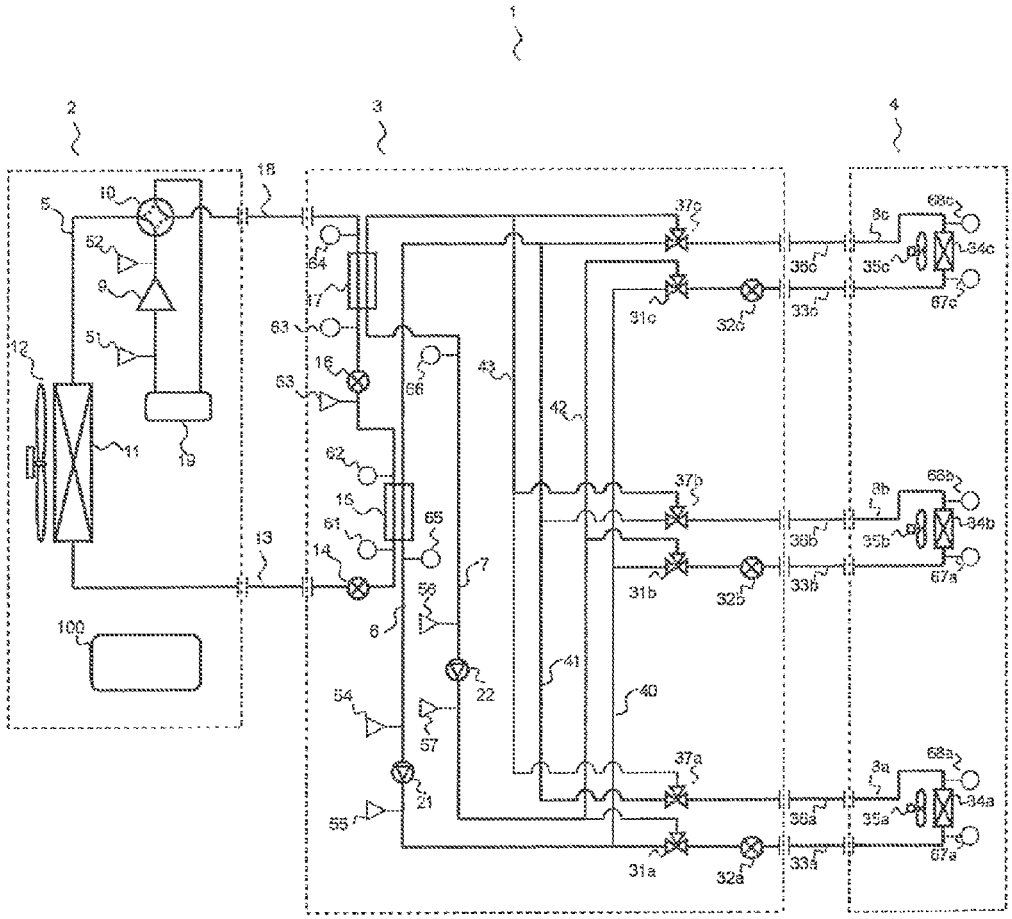
FIG. 3 is a circuit diagram related to an operation in which the air conditioning apparatus according to the embodiment of the present invention performs cooling-main operation.
Figure 4:
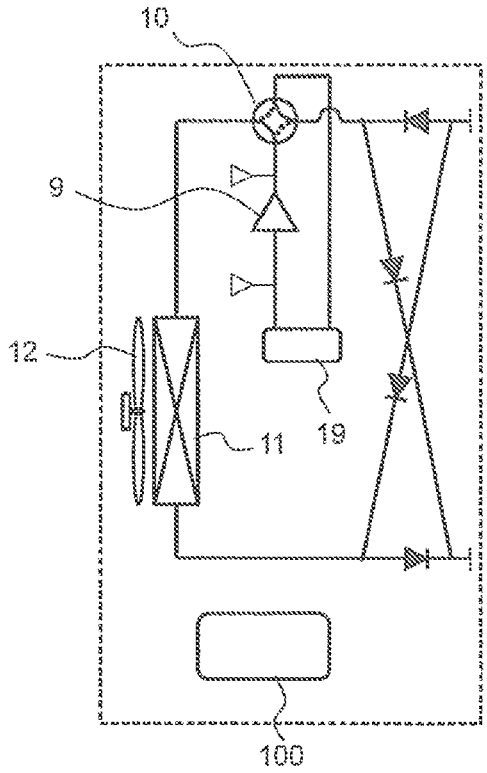
FIG. 4 is a circuit diagram showing main components in another example of an air conditioning apparatus according to a different embodiment of the present invention.
Figure 5:
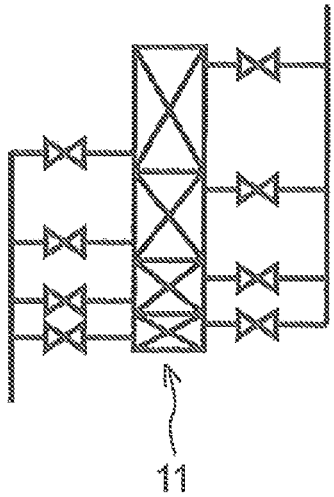
FIG. 5 is a circuit diagram showing main components in yet another example of an air conditioning apparatus according to a different embodiment of the present invention.
Figure 6:
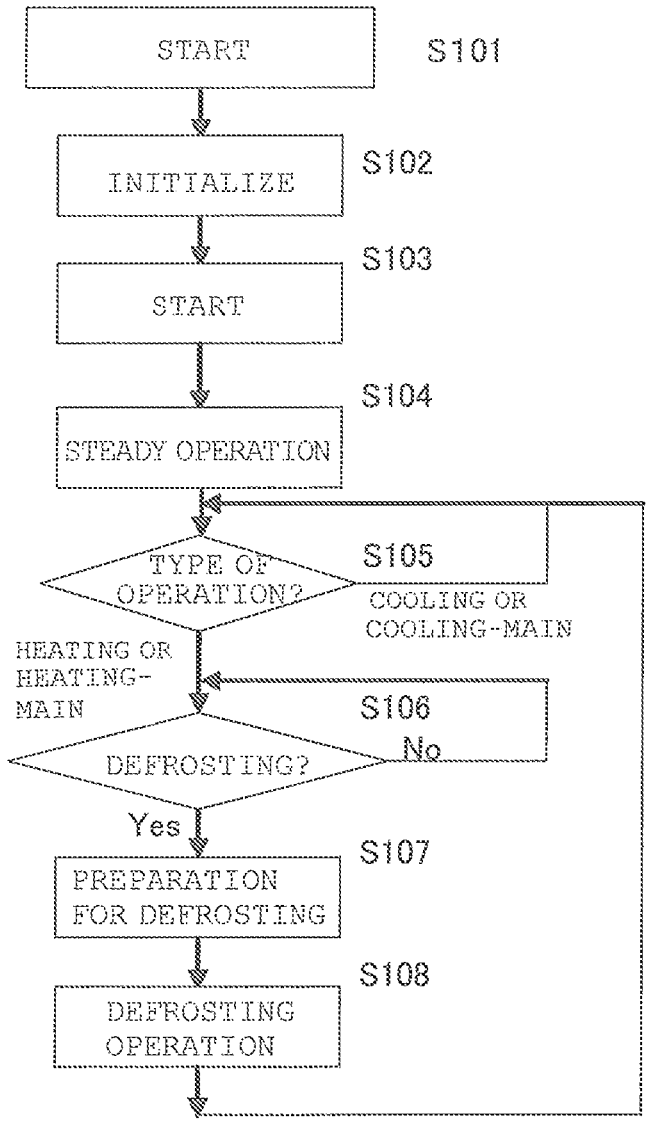
FIG. 6 is a flowchart illustrating an operation in normal operation by the air conditioning apparatus according to the embodiment of the present invention.
Figure 7:
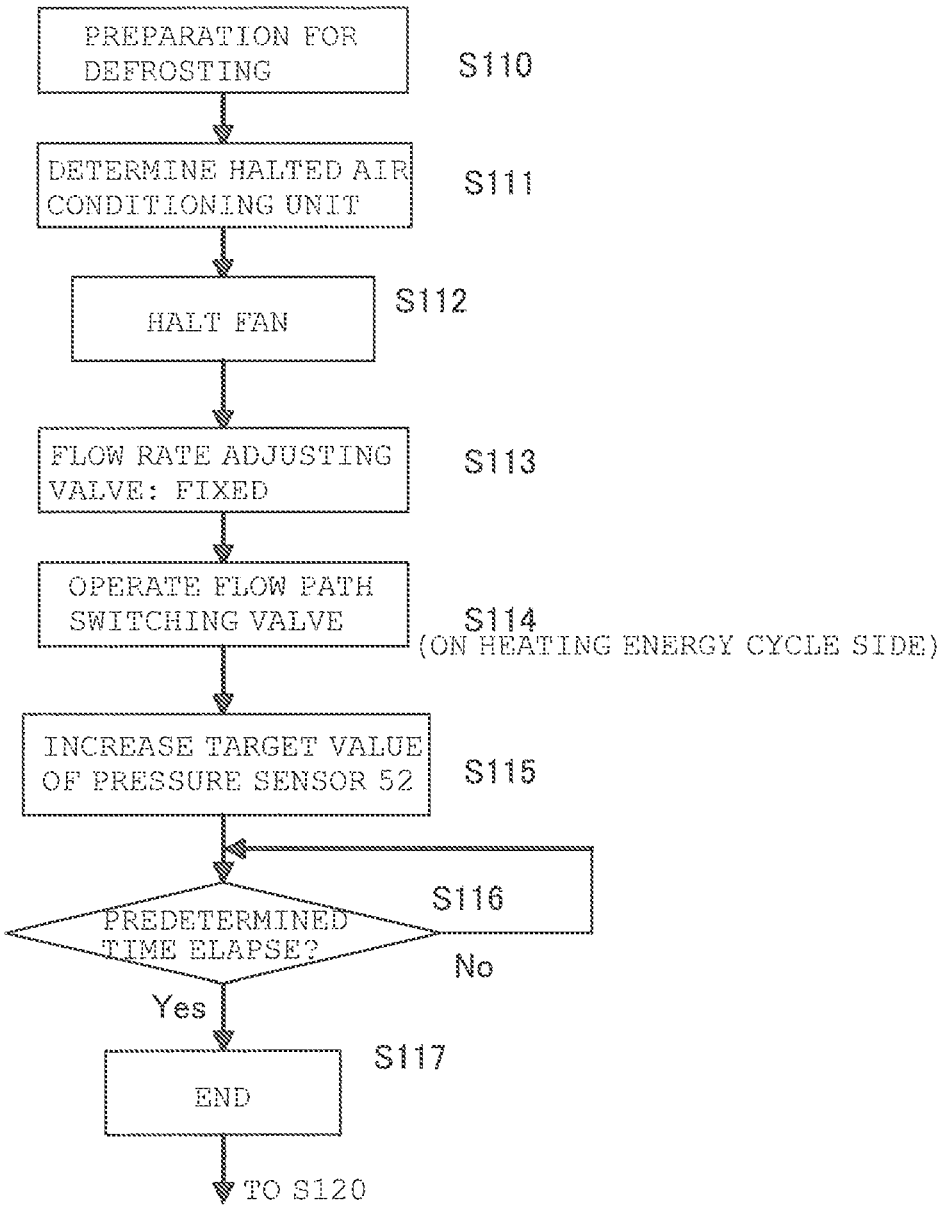
FIG. 7 is a flowchart illustrating an operation in preparation for defrosting by the air conditioning apparatus according to the embodiment of the present invention.
Figure 8:
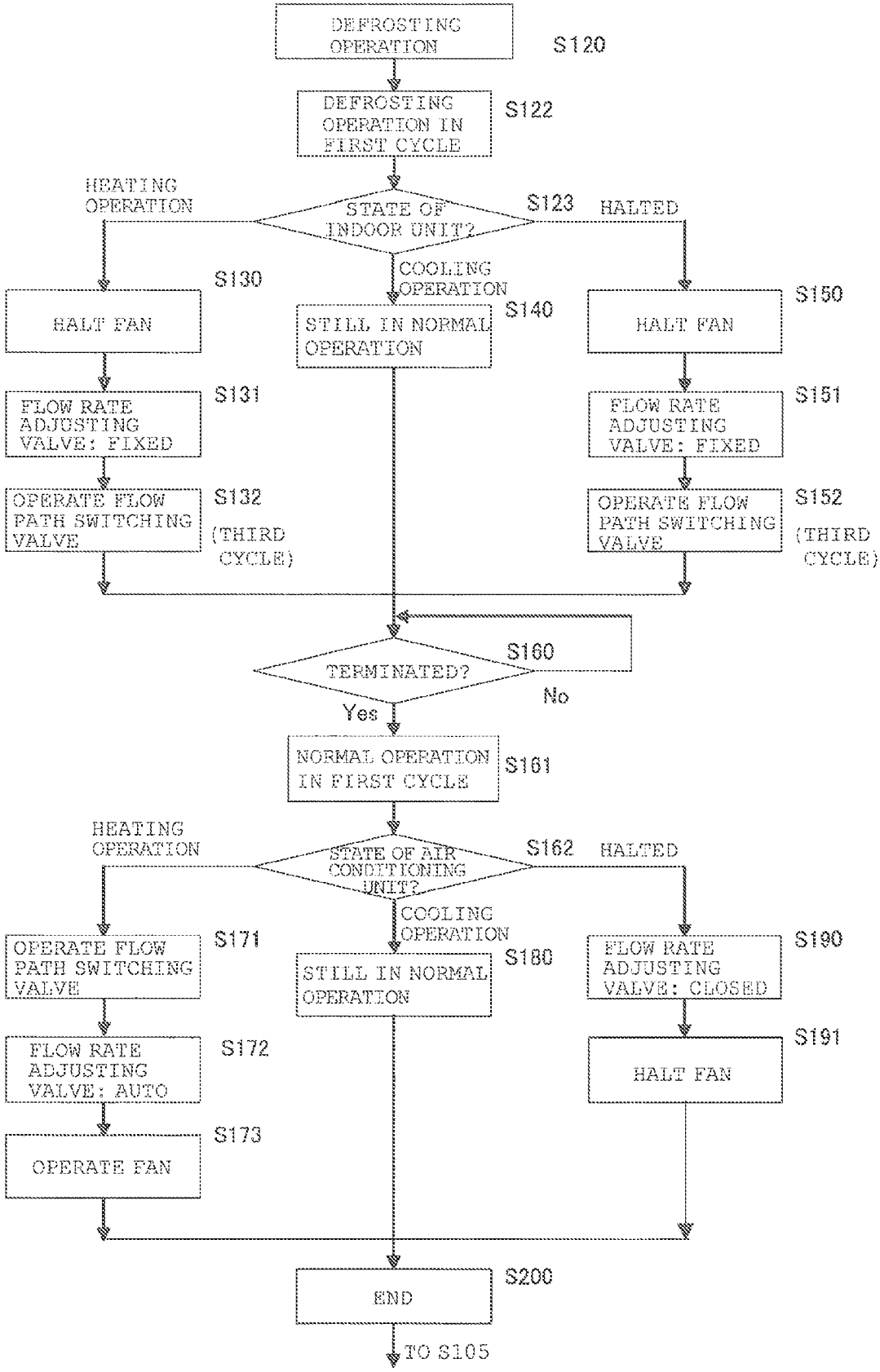
FIG. 8 is a flowchart illustrating an operation in defrosting by the air conditioning apparatus according to the embodiment of the present invention.
Figure 9:
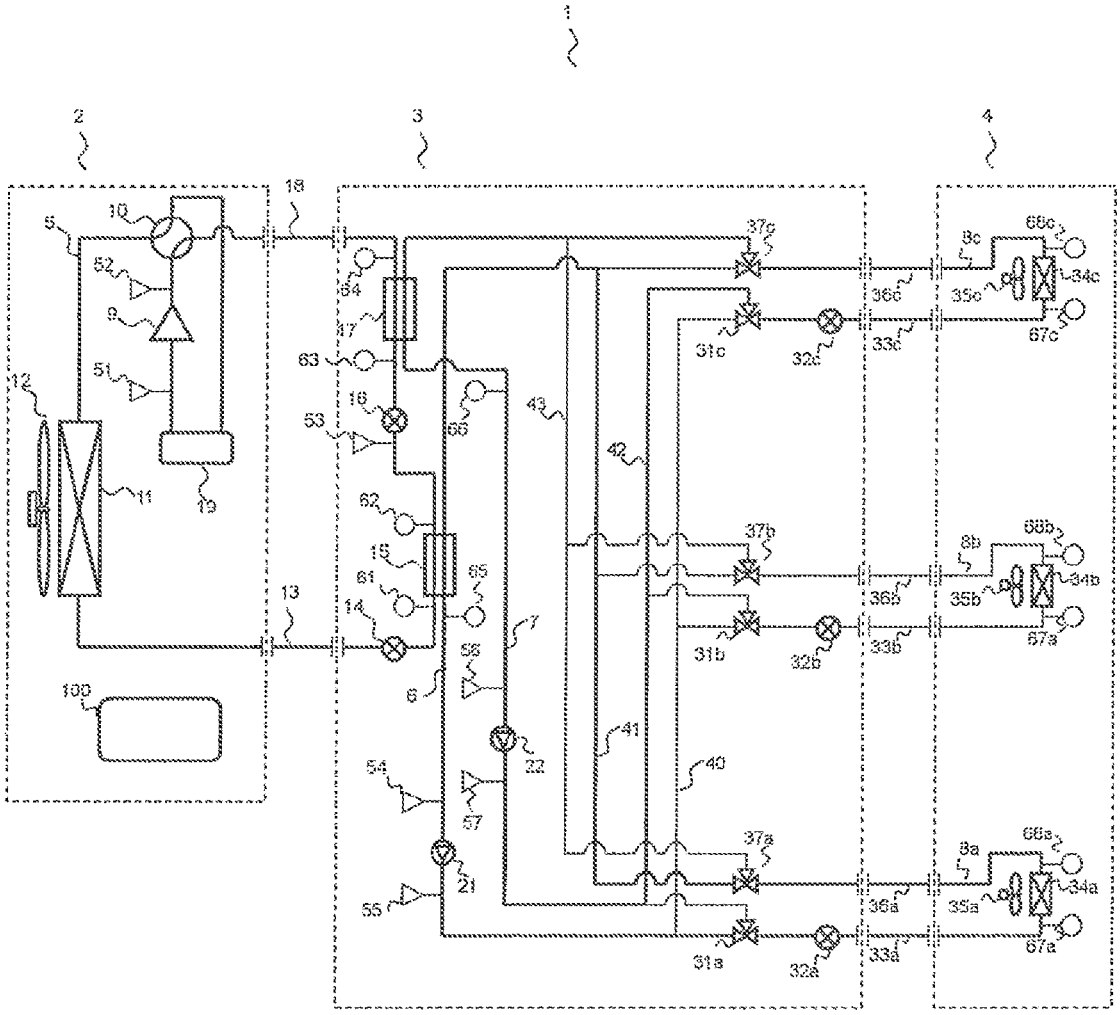
FIG. 9 is a circuit diagram related to an operation performed before the air conditioning apparatus according to the embodiment of the present invention performs defrosting.
Figure 10:
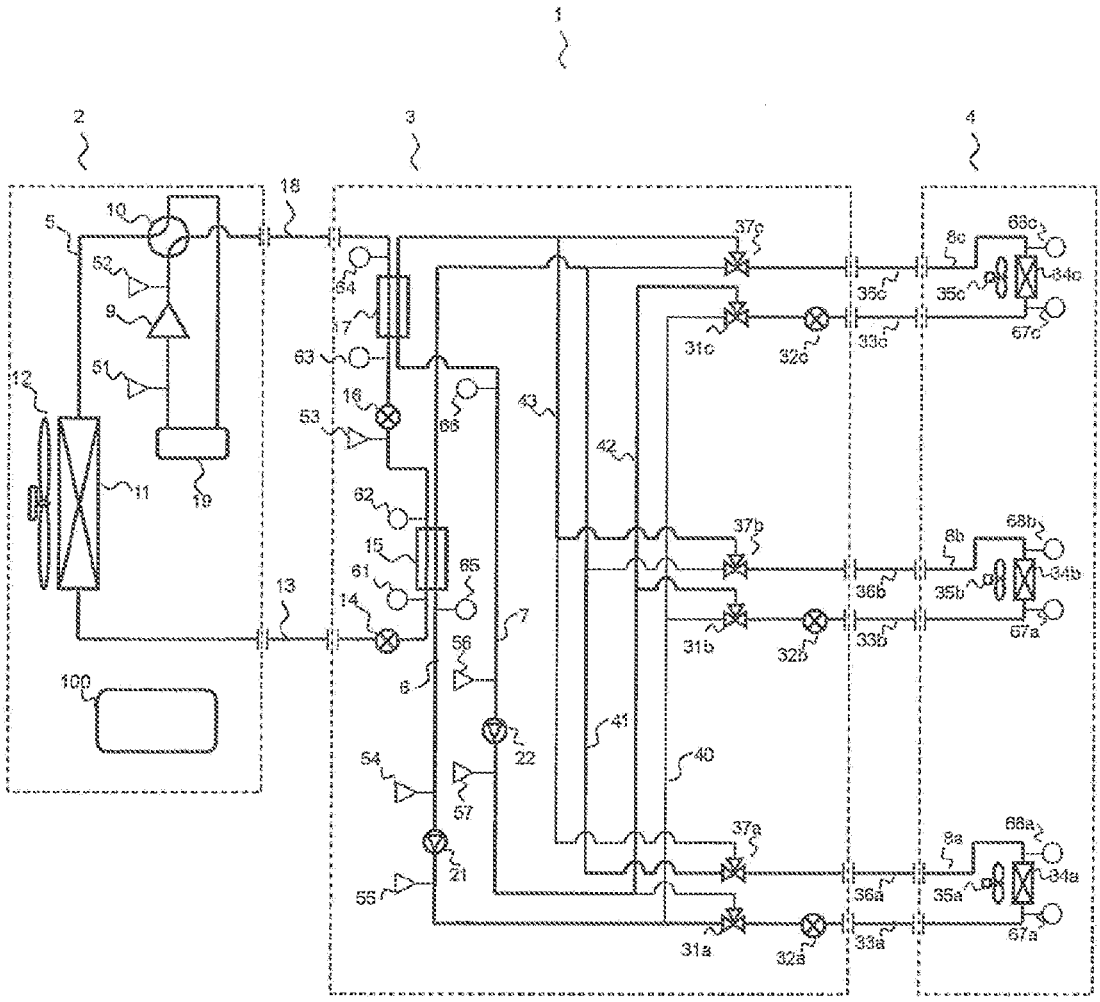
FIG. 10 is a circuit diagram related to an operation performed when the air conditioning apparatus according to the embodiment of the present invention prepares for defrosting.
Figure 11:
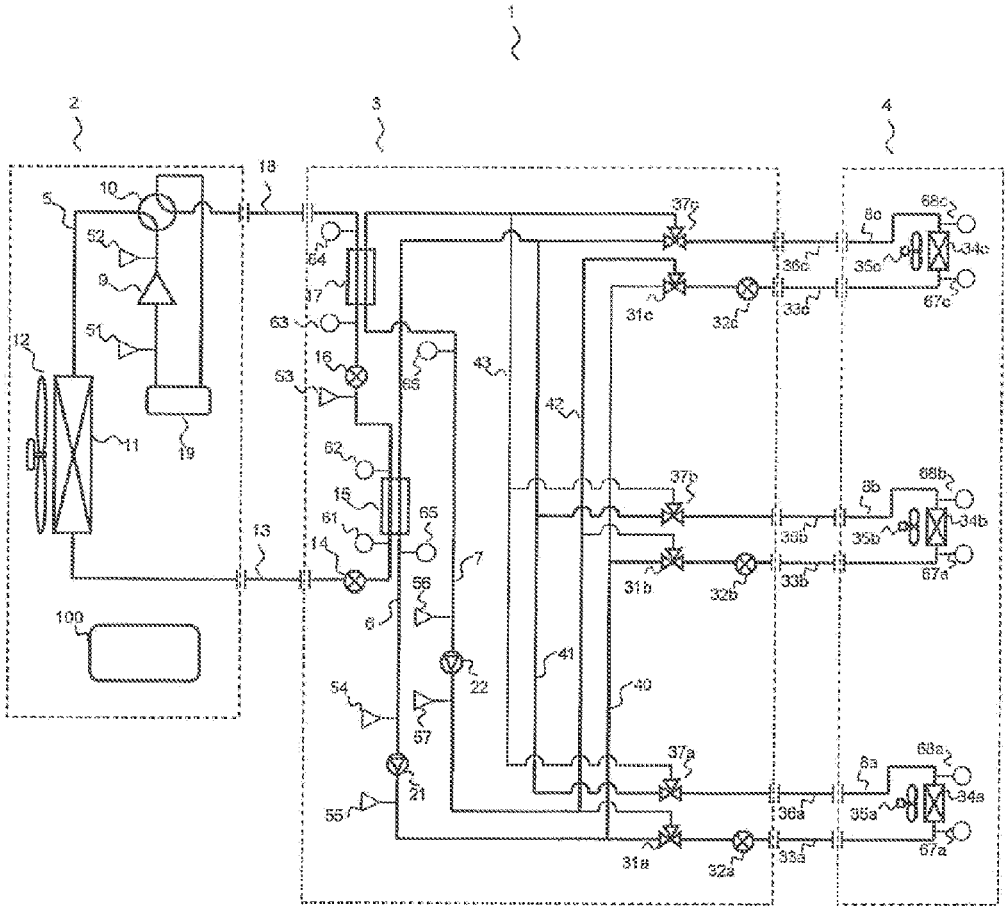
FIG. 11 is a circuit diagram related to an operation performed when the air conditioning apparatus according to the embodiment of the present invention performs defrosting operation.

FIG. 1 is a circuit diagram showing the structure of an aft conditioning apparatus according to an embodiment of the present invention. FIG. 2 is a circuit diagram related to an operation in which the air conditioning apparatus according to the embodiment of the present invention performs cooling only operation. FIG. 3 is a circuit diagram related to an operation in which the it conditioning apparatus according to the embodiment of the present invention performs cooling-main operation. FIG. 4 is a circuit diagram showing main components in another example of an air conditioning apparatus according to an embodiment of the present invention. FIG. 5 is a circuit diagram showing main components in yet another example of an air conditioning apparatus according to an embodiment of the present invention. FIG. 6 is a flowchart illustrating an operation in normal operator performer the air conditioning apparatus according to the embodiment of the present invention. FIG. 7 is a flowchart illustrating an operation in preparation for defrosting performed by the air conditioning apparatus according to the embodiment of the present invention. FIG. 8 is a flowchart illustrating an operation in defrosting performed by the air conditioning apparatus according to the embodiment of the present invention. FIG. 9 is a circuit diagram related to an Operation performed before the air conditioning apparatus according to the embodiment of the present invention performs defrosting. FIG. 10 is a circuit diagram related to an operation performed when the air conditioning apparatus according to the embodiment of the present invention prepares for defrosting. FIG. 11 is a circuit diagram related to an operation performed when the air conditioning apparatus according to the embodiment of the present invention performs defrosting operation. In FIGS. 2, 3, and 9 to 11 above, open pipes are indicated by thick lines (solid lines), and closed pipes are indicated by thin lines (solid lines).

As shown in FIG. 1, the air conditioning apparatus 1 according to this embodiment includes a heat source unit 2, a relay unit 3, and a load unit 4. The heat source unit 2 is disposed on the rooftop of a building, in an outdoor place, or in a machine room located, for example, underground. The load unit 4 is disposed in or near a living room. The relay unit may be disposed adjacent to the heat source unit 2 or near the living room.

The air conditioning apparatus 1 includes a first cycle 5 in which a first medium is circulated, a second cycle 6 in which a second medium is circulated, and a third cycle 7 in which the second medium is circulated. The first medium is not limited to a fluorocarbon refrigerant; it may be a natural medium. The second medium may be water, water to which an additive such as an antiseptic agent is added or brine.

The first cycle 5 is formed by connecting a compressor 9, a four-way valve 10, a first heat exchanger 11, an outdoor unit fan 12 attached to it, a first extension pipe 13, a first decompression valve 14, a second heat exchanger 15, a second decompression valve 16, a third heat exchanger 17, a second extension pipe 18, the four-way valve 10, an accumulator 19, and the compressor 9 in that order.

The second cycle 6 is formed by connecting a second heat exchanger 15, a first pump 21, a first branching path 40, a plurality of branching paths 8*a* to 8*c*, a first merging path 41, and the second heat exchanger 15 in that order.

The third cycle 7 is formed by connecting a third heat exchanger 17, a second pump 22, a second branching path 42, the plurality of branching paths 8*a* to 8*c*, a second merging path 43, and the third heat exchanger 17 in that order.

The plurality of branching paths 8*a* to 8*c* include first flow path switching valves 31*a* to 31*c*, flow rate adjusting valves 32*a* to 32*c*, third extension pipes 33*a* to 33*c*, indoor units 34*a* to 34*c*, indoor unit fans 35*a* to 35*c* attached to them, fourth extension pipes 36*a* to 36*c*, and second flow path switching valves 37*a* to 37*c*.

Next, the operations (various operation modes) of the air conditioning apparatus according to this embodiment will be described.

Cooling Operation Mode

First, a case in which cooling only operation is performed will be described with reference to FIG. 2.

In the air conditioning apparatus 1, the four-way valve 10 is connected as indicated by the solid lines; the first medium compressed b the compressor 9 to a pressurized high-temperature state passes through the four-way valve 10, enters the first heat exchanger 11, and dissipates heat to the outside air supplied by the outdoor unit fan 12, by which the first medium is placed in a pressurized low-temperature state. The first medium then passes through the first extension pipe 13, is subjected to pressure reduction by the first decompression valve 14, by which the first medium has a low drying degree under a low pressure. The first medium then passes through the second heat exchanger 15, second decompression valve 16, and third heat exchanger 17. The second decompression valve 16 is fully open, so pressure loss is small. The second heat exchanger 15 exchanges heat between the first cycle 5 and second cycle 6, and the third heat exchanger 17 exchanges heat between the first cycle 5 and third cycle 7. When cooling energy is thereby supplied to the second medium, the first medium evaporates and becomes a as having a high drying degree under a low pressure or an overheated gas under a low pressure. The first medium then passes through the second extension pipe 18, four-way valve 10, and accumulator 19, and enters the compressor 9 again.

A controller 100 functions as described below. That is, the controller 100 controls the rotation speed of the compressor 9 so that the pressure detected by a pressure sensor 51 becomes constant, and controls the processing capacity of the first heat exchanger 11 by using, for example, the outdoor unit fan 12 attached to the first heat exchanger 11 so that the pressure detected by as pressure sensor 52 becomes constant. In this case, the second decompression valve 16 is fully open. Therefore, the controller 100 controls the opening-degree of the first decompression valve 14 so that the superheat at the outlet of the third heat exchanger 17, which is obtained from expression (1) below, becomes constant.

$$\text{(Superheat at outlet)}=\text{(value detected by temperature sensor 64)}-\text{(converted value of saturation temperature for pressure sensor 51)} \quad (1)$$

Then, an appropriate cooling capacity can be attained on the basis of the number of indoor units 34*a* to 34*c* in operation.

The opening-degrees of the flow rate adjusting valves 32*a* to 32*c* are controlled so that differences in temperatures between the inlets and outlets of their corresponding indoor units 34*a* to 34*c*, each of which is obtained from expression (2) below, become constant.

$$\text{(Difference in temperatures between inlet and outlet)}=\text{(value detected by temperature sensor 67)}-\text{(value detected by temperature sensor 68)} \quad (2)$$

The rotation speed of the first pump 21 is controlled so that a first pressure difference, which is obtained from expression (3) below, becomes constant.

(First pressure difference)=(value detected by pressure sensor 55)−(value detected by pressure sensor 54) (3)

The rotation speed of the second pump 22 is controlled so that a second pressure difference, which is obtained from expression (4) below, becomes constant.

(Second pressure difference)=(value detected by pressure sensor 57)−(value detected by pressure sensor 56) (4)

Then, the second medium can be properly circulated in each of the indoor units 34*a* to 34*c*.

In the second cycle 6 to which cooling energy has been supplied from the first cycle 5 through the second heat exchanger 15, the second medium, which is at a low temperature, is circulated by the first pump 21 and enters the branching paths 8*a* and 8*b* through the first flow path switching valves 31*a* and 31*b*. The flow rates of the second medium passing through the branching paths 8*a* and 8*b* are determined by the flow rate adjusting valves 32*a* and 32*b* on the basis of their degrees of resistance (opening-degrees). The second medium passes through the third extension pipes 33*a* and 33*b* and enters the indoor units 34*a* and 34*b*. Then, the second medium is subjected to heat exchange with the it in the living room by the indoor unit fans 35*a* and 35*b* and supplies cooling energy to the load side, the temperature of the second medium being increased. The high-temperature second medium further passes through the fourth extension pipes 36*a* and 36*b* and then passes through the second flow path switching valves 37*a* and 37*b*, after which the second medium merges at the first merging path 41 and enters the second heat exchanger 15 again.

On the other hand, in the third cycle 7 to which cooling energy has been supplied from the first cycle 5 through the third heat exchanger 17, the second medium, which is at a low temperature, is circulated by the second pump 22 from the second branching path 42 to the branching path 8*c* through the first flow path switching valve 31*c*, The flow rate of the second medium passing through the branching path 8*c* is determined by the flow rate adjusting valve 32*c* on the basis of its degree of resistance (opening-degree). The second medium passes through the third extension pipe 33*c* and enters the indoor unit 34*c*. Then, the second medium is subjected to heat exchange with the air in the living room by the indoor unit fan 35*c* and supplies cooling energy to the load side, the temperature of the second medium being increased. The high-temperature second medium further passes through the fourth extension pipe 36*c* and then passes through the second flow path switching valve 37*c*, after which the second medium enters the third at exchanger 17 again.

If there is a halted indoor unit, this indicates that its corresponding flow rate adjusting valve is fully dosed or its corresponding flow path switching valve communicates with neither the second cycle 6 no the third cycle 7.

Cooling Operation Mode (When Different Temperatures Are Desired)

Next, a case in which different temperatures are desired when cooling only operation is performed will be described with reference to FIG. 2.

In the air conditioning apparatus 1, the four-way valve 10 is connected as indicated by the solid lines; the first medium compressed by the compressor 9 to a pressurized high-temperature state passes through the four-way valve 10, enters the first heat exchanger 11, and dissipates heat to the outside air supplied by the outdoor unit fan 12, by Which the first medium is placed in a pressurized low-temperature state. The first medium then passes through the first extension pipe 13 and is subjected to pressure reduction by the first decompression valve 14, by which the first medium has a low drying degree under a low pressure. The first medium then passes through the second heat exchanger 15, second decompression valve 16, and third heat exchanger 17. A pressure drop occurs at the second decompression valve 16, and the converted values of saturation temperatures at the pressures before and after the passage correspond to the desired temperatures. The second heat ex changer 15 exchanges heat between the first cycle 5 and second cycle 6, and the third heat exchanger 17 exchanges heat between the first cycle 5 and third cycle 7. When cooling energy is supplied to the second medium, the first medium evaporates and becomes a gas having a high drying degree under a low pressure or an overheated gas under a low pressure. The first medium then passes through the second extension pipe 18, four-way valve 10, and accumulator 19, and enters the compressor 9 again.

The controller 100 functions as described below. That is, the controller 100 controls the rotation speed of the compressor 9 so that the pressure detected by the pressure sensor 61 becomes constant, and controls the processing capacity of the first heat exchanger 11 by using, for example, the outdoor unit fan 12 so that the pressure detected by the pressure sensor 52 becomes constant In this mode as well, the controller 100 controls the opening-degree of the first decompression valve 14 so that the superheat at the outlet of the third heat exchanger 17, which is obtained from expression (1) above, becomes constant.

The opening-degree of the second decompression valve 16 is controlled so that the temperature difference obtained from expression (5) below becomes the desired temperature difference.

(Temperature difference)=(converted value of saturation temperature for pressure sensor 53)−(converted value of saturation temperature for pressure sensor 51) (5)

Then, an appropriate cooling capacity can be attained on the basis of the number of indoor units in operation.

In the second cycle 6 to which cooling energy has been supplied from the first cycle 5 through the second heat exchanger 15, the cooling energy is supplied from the first medium under a pressure before the pressure is decreased by the second decompression valve 16, so that the evaporation temperature is higher than that of the third cycle and the blow-out air temperature of the indoor unit is high.

In contrast, in the third cycle 7 to which cooling energy has been supplied from the first cycle 5 through the third heat exchanger 17, the cooling energy is supplied from the first medium under a pressure before a drop of pressure is caused by the second decompression valve 16, so the evaporation temperature is lower than in the second cycle 6 and the outlet air temperature of the indoor unit is thereby low.

The controller 100 functions as described below. That is, in this mode as well, the controller 100 controls the opening-degrees of the flow rate adjusting valves 32*a* to 32*c* so that the differences in temperatures between the inlets and outlets, each of which is obtained from expression (2) above, become constant.

In this mode as well, the controller 100 controls the rotation speed of the first pump 21 so that the first pressure difference, which is obtained from expression (3) above, becomes constant, In this mode as well, the controller 100 controls the rotation speed of the second pump 22 so that the second pressure difference, which is obtained from expression (4) above, becomes constant.

Then, the second medium can be appropriately circulated in the indoor units 34*a* to 34*c*.

In this mode as well, if there is a halted indoor unit, this indicates that its corresponding flow rate adjusting valve is fully closed or its corresponding flow path switching valve communicates with neither the second cycle 6 nor the third cycle 7.

Cooling heating Simultaneous Operation Mode (In Case of Cooling-Main Operation)

Next, a case in which cooling and heating are carded out simultaneously with the cooling capacity being larger than the heating capacity (cooling-main operation) will be described with reference to FIG. 3.

In the air conditioning apparatus 1, the four-way valve 10 is connected as indicated by the solid lines; the first medium compressed by the compressor 9 to a pressurized high-temperature state passes through the four-way valve 10, enters the first heat exchanger 11, and dissipates heat to the outside air supplied by the outdoor unit fan 12, by which the first medium is placed in a pressurized medium-temperature state if the pressure is equal to or higher than the critical pressure. The first medium then passes through the first extension pipe 13, first decompression valve 14, and second heat exchanger 15. The first decompression valve 14 is fully open. The second heat exchanger 15 exchanges heat between the first cycle 5 and second cycle 6 and supplies heating energy to the second medium. Accordingly, the first medium is placed in a pressurized low-temperature state. Then, the first medium passes through the second decompression valve 18 and has a low drying degree under a low pressure. The third heat exchanger 17 exchanges heat between the first cycle 5 and third cycle 7 and supplies cooling energy to the second medium. Accordingly, the first medium evaporates and becomes a gas having a high drying degree under a low pressure or an overheated gas under a low pressure. The first medium then passes through the second extension pipe 18, four-way valve 10, and accumulator 19 and enters the compressor 9 again.

The controller 100 functions as described below. That is, the controller 100 controls the rotation speed of the compressor 9 so that the pressure detected by the pressure sensor 51 becomes constant, and controls the processing capacity of the first heat exchanger 11 by, for example, the outdoor unit fan 12 so that the pressure detected by the pressure sensor 52 becomes constant. In this case, the opening-degree of the first decompression valve 14 is fully open. Therefore, the controller 100 controls the opening degree of the second decompression valve 16 so that the superheat at the outlet of the third heat exchanger 17, which is obtained from expression (6) below, becomes constant.

$$\text{(Superheat at outlet)}=\text{(value detected by temperature sensor 64)}-\text{(Converted value of saturation temperature for pressure sensor 51)} \quad (6)$$

Then, appropriate cooling capacity and heating capacity can be attained on the basis of the number of indoor units 34*a* to 34*c* in operation.

In the second cycle 6 to which heating energy has been supplied from the first cycle 5 through the second heat exchanger 16, the second medium, which is at a high temperature, is circulated by the first pump 21 and enters the branching path 8*a* through the first flew path switching valve 31*a*. The flow rate of the second medium passing through the branching path 8*a* is determined by the flow rate adjusting valve 32*a* on the basis of its degree of resistance (opening-degree). The second medium passes through the third extension pipe 33*a* and enters the indoor unit 34*a*. Then, the second medium is subjected to heat exchange with the air in the living room by the indoor unit fan 35*a* and supplies heating energy to the load side, the temperature of the second medium being lowered. The low-temperature second medium passes through the fourth extension pipe 36*a* and then passes through the second flow path switching valve 37*a*, after which the second medium passes through the first merging path 41 and enters the second heat exchanger 15 again.

In the third cycle 7 to which cooling energy has been supplied from the first cycle 5 through the third heat exchanger 17, the second medium, which is at a low temperature, is circulated by the second pump 22 and enters the branching paths 8*b* and 8*c* from the second merging path 42 through the first flow path switching valves 31*b* and 31*c*. The flow rates of the second medium passing through the branching paths 8*b* and 8*c* are determined by the flow rate adjusting valves 32*b* and 32*c* on the basis of their degrees of resistance (opening-degrees). The second medium passes through the third extension pipes 33*b* and 33*c* and enters the indoor units 34*b* and 34*c*. Then, the second medium is subjected to heat $ exchange with the air in the living room by the indoor unit fans 35*h* and 35*c* and supplies cooling energy to the load side, the temperature of the second medium being increased. The high-temperature second medium passes through the fourth extension pipes 36*b* and 36*c* and then passes through the second flow path switching valves 37*b* and 37*c*, after which the second medium merges at the second merging path 43 and enters the third heat exchanger 17 again.

Heating Operation Mode

Next, a case in which heating only operation is performed will be described with the reference to FIG. 2.

In the air conditioning apparatus 1, the four-way valve 10 is connected as indicated by the dotted lines; the first medium compressed by the compressor 9 to a high-pressure high-temperature state passes through the four-way valve 10, and then pass through the second extension pipe 18, third heat exchanger 17, second decompression valve 16, and second heat exchanger 15. The second decompression valve 16 is fully open, and pressure loss is thereby small, When passing through the third heat exchanger 17 and second heat exchanger 15, the first medium is subjected to heat exchange with the third cycle 7 and second cycle 6, by which the first medium is paced in a pressurized low-temperature state. Then, the first medium passes through the first decompression valve 14 and has a low drying degree under a low pressure. The first medium then passes through the first extension pipe 13, enters the first heat exchanger 11, and absorbs heat from outside air supplied by the outdoor unit fan 12, by which the first medium has a high drying degree under a low pressure. The first medium then passes through the four-way valve 10 and accumulator 19, and enters the compressor 9 again. As for an air conditioning unit for a building, an excess refrigerant is generated during heating rather than cooling, depending on the size of the heat exchanger and the arrangement of the extension pipes and decompression valves, as already described. Accordingly, to assure reliability, the excess refrigerant is stored in the accumulator 19 to prevent the liquid refrigerant from entering the compressor 9.

The controller 100 functions as described below. Thetis the controller 100 controls the rotation speed of the compressor 9 so that the pressure detected by the pressure sensor 52 becomes constant, and controls the processing capacity of the first heat exchanger 11 by using, for example, the outdoor unit fan 12 so that the pressure detected by the pressure sensor 51 becomes constant In this case, the second decompression valve 16 is fully open. Therefore, the controller 100 controls the opening-degree of the first decompression valve 14 so that the sub-cool at the outlet of the second heat exchanger 15, which is obtained from expression (7) below, becomes constant.

(Sub-cool at outlet)=(converted value of saturation temperature for pressure sensor 52)−(value detected by temperature sensor 61) (7)

Then, appropriate heating capacity can be attained on the basis of the number of indoor units 34*a* to 34*c* in operation.

In the third cycle 7 to which heating energy has been supplied from the first cycle 5 through the third heat exchanger 17, the second medium, which is at a high temperature, is circulated by the second pump 22 and enters the branching path 8*c* through the first flow path switching valve 31*c*. The flow rate of the second medium passing through the branching path Be is determined by the flow rate adjusting valve 32*c* on the basis of its degree of resistance (opening-degree). The second medium passes through the third extension pipe 33*c* and enters the indoor unit 34*c*. Then, the second medium is subjected to heat exchange with the air in the living room by the indoor unit fan 35*c* and supplies heating energy to the load side, the temperature of the second medium being decreased. The low-temperature second medium further passes through the fourth extension pipe 36*c* and then passes through the second flow path switching valve 37*c*, after which the second medium enters the third heat exchanger 17 again.

In the second cycle 6 to which heating energy has been supplied from the first cycle 5 through the second heat exchanger 15, the second medium, which is at a high temperature, is circulated by the first pump 21 to reach the branching paths 8*a* and 8*b* through the first flow path switching valves 31*a* and 31*b*, The flow rates of the second medium passing through the branching paths 8*a* and 8*b* are determined by the flow rate adjusting valves 32*a* and 32*b* on the basis of their degrees of resistance (opening-degrees). The second medium passes through the third extension pipes 33*a* and 33*b* and enters the indoor units 34*a* and 34*b*. Then, the second median is subjected to heat exchange with the air in the living room by the indoor unit fans 35*a* and 36*b* and supplies heating energy to the load side, the temperature of the second medium being decreased. The low temperature second medium passes through the fourth extension pipes 30*a* and 36*b* and then passes through the second flow path switching valves 37*a* and 37*b*, after which the second medium merges at the first merging path 41 and enters the second heat exchanger 15 again.

The controller 100 functions as described below. That is, the controller 100 controls the opening-degrees of the flow rate adjusting valves 32*a* to 32*c* so that the differences in temperatures between the inlets and outlets of their corresponding indoor units 34*a* to 34*c*, each of which is obtained from expression (2) above, become constant. The controller 100 also controls the rotation speed of the first pump 21 so that the first pressure difference, which is obtained from expression (3) above, becomes constant. Furthermore, the controller 100 controls the rotation speed of the second pump 22 so that the second pressure difference, which is obtained from expression (4) above, becomes constant.

Then, the second medium can be appropriately circulated in the indoor units 34*a* to 34*c*.

In this mode as well, if there is a halted indoor unit, this indicates that its corresponding flow rate adjusting valve is fully closed or its corresponding flow path switching valve communicates neither the second cycle 6 no the third cycle 7.

Heating Operation Mode (When Different Temperatures Are Desired)

Next, a case in which different temperatures are desired when heating only operation is performed will be described with reference to FIG. 3 used before.

In the air conditioning apparatus 1, the four-way valve 10 is connected as indicated by the dotted lines; the first medium compressed by the compressor 9 to a pressurized high-temperature state passes through the four-way valve 10, and then pass through the second extension pipe 18, third heat exchanger 17, second decompression valve 16, and second heat exchanger 15. A pressure drop occurs at the second decompression valve 16, and the converted values of the saturation temperatures at the pressures before and after the first medium passes correspond to the desired temperatures. When passing through the third heat exchanger 17 and second heat exchanger 15, the first medium is subjected to heat exchange with the third cycle 7 and second cycle 6, by which the first medium is placed in a pressurized low-temperature state. Then, the first medium passes through the first decompression valve 14 and has a low drying decree under a low pressure. The first medium then passes through the first extension pipe 13, enters the first heat exchanger 11, and absorbs heat from outside air supplied by the outdoor unit fan 12, by which the first medium has a high drying degree under a low pressure. The first medium then passes through the four-way valve 10 and accumulator 19, and enters the compressor 9 again. As for an air conditioning unit for a building, an excess refrigerant is generated during heating rather than cooling, depending on the size of the heat exchanger and the arrangement of the extension pipes and decompression valves, as already described. In this mode as well, therefore, to assure reliability, the excess refrigerant during the heating is stored in the accumulator 19 to prevent the liquid refrigerant from entering the compressor 9.

The controller 100 functions as described below. That is, the controller 100 controls the rotation speed Of the compressor 9 so that the pressure detected by the pressure sensor 52 becomes constant, and controls the processing capacity of the first heat exchanger 11 by, for example, the outdoor unit fan 12 so that the pressure detected by the pressure sensor 51 becomes constant. The controller 100 also controls the opening-degree of the second decompression valve 16 so that the temperature difference obtained from expression (8) below becomes a desired temperature difference.

(Temperature difference)=(converted value of saturation temperature of pressure sensor 52)−(converted value of saturation temperature of pressure sensor 53) (8)

The controller 100 also controls the opening-degree of the first decompression valve 14 so that the sub-cool at the outlet of the second heat exchanger 15, which is obtained from expression (7) above, becomes constant. Then, an appropriate heating capacity can be attained on the basis of the number of indoor units 34*a* to 34*c* in operation.

In the third cycle 7 to which heating energy has been supplied from the first cycle 5 through the third heat exchanger 17, the heating energy is supplied from the first medium under a pressure before a drop of pressure is caused by the second decompression valve 16, so the temperature of the second medium is higher than in the second cycle and the outlet air temperature of the indoor unit is thereby high.

In contrast, in the second cycle 6 to which heating energy has been supplied from the first cycle 5 through the second heat exchanger 15, the heating energy is supplied from the first medium under a pressure after a drop of pressure, has been caused by the second decompression valve 16, so the temperature of the second medium is lower than in the third cycle 7 and the blow-out air temperature of the indoor unit is low.

The controller 100 functions as described below. That is, the controller 100 controls the opening-degrees of the flow rate adjusting valves 32*a* to 32*c* so that the differences in temperatures between the inlets and outlets of their corresponding indoor units 34*a* to 34*c*, each of which is obtained from expression (2) above, become constant. The controller 100 also controls the rotation speed of the first pump 21 so that the first pressure difference, which is obtained from expression (3) above, becomes constant. Furthermore, the controller 100 controls the rotation speed of the second pump 22 so that the second pressure difference, which is obtained from expression (4) above, becomes constant. Then, the second medium 2 can be appropriately circulated in the indoor units.

In this mode as well, if there is a halted indoor unit this indicates that its corresponding flow rate adjusting valve is fully closed or its corresponding flow path switching valve communicates neither the second cycle 6 nor the third cycle 7.

Cooling Heating Simultaneous Operation Mode (In Case of Heating-Main Operation)

Next, a case in which cooling and heating are carried out simultaneously with the heating capacity being larger than the cooling capacity (heating-main operation) will be described with reference to FIG. 3.

In the air conditioning apparatus 1, the four-way valve 10 is connected as indicated by the dotted lines; the first medium compressed by the compressor 9 to a pressurized high-temperature state passes through the four-way valve 10, and then pass through the second extension pipe 18 and third heat exchanger 17. When passing through the third heat exchanger 17, the first medium is subjected to heat exchange with the third cycle 7, by which the first medium is placed in a pressurized low-temperature state. Then, the first medium is subjected to pressure reduction by the second decompression valve 16, by which the first medium has a low drying degree under a low pressure. The first medium then passes through the second heat exchanger 15. During this passage, the first medium is subjected to heat exchange with the second cycle 6, by which the first medium has a low drying degree under a low pressure. The first medium then passes through the fully open first decompression valve 14 and first extension pipe 13, enters the first heat exchanger 11, and absorbs heat from outside air supplied by the outdoor unit fan 12, forming two low pressure phases. The first medium then passes through the four-way valve 10 and accumulator 19, and enters the compressor 9 again. As for an air conditioning unit for a building an excess refrigerant is generated during heating rather than cooling, depending on the size of the heat exchanger and the arrangement of the extension pipes and decompression valves, as already described. Accordingly, to assure reliability, the excess refrigerant is stored in the accumulator 19 to prevent the liquid refrigerant from entering the compressor 9.

The controller 100 functions as described below. That is, the controller 100 controls the rotation speed of the compressor 9 so that the pressure detected by the pressure sensor 52 becomes constant, and controls the processing capacity of the first heat exchanger 11 by, for example, the outdoor unit fan 12 so that the pressure detected by the pressure sensor 51 becomes constant. In this case, the opening-degree of the first decompression valve 14 is fully open. Therefore, the controller 100 controls the opening-degree of the second decompression valve 16 so, that the sub-cool at the outlet of the third heat exchanger 17, which is obtained from expression (9) below, becomes constant.

$$\text{(Sub-cool at outlet)}=\text{(converted value of saturation temperature for pressure sensor 52)}-\text{(value detected by temperature sensor 63)} \quad (9)$$

Then, appropriate heating capacity and cooling capacity can be attained on the basis of the number of indoor units 34*a* to 34*c* in operation.

In the third cycle 7 to which heating energy has been supplied from the first cycle 5 through the third neat exchanger 17, the second medium, which is at a hi oh temperature, is circulated by the second pump 22 and enters the branching paths 8*b* and 8*c* through the first flow path switching valves 31*b* and 31*c*, The flow rate of the second medium passing through the branching paths 8*b* and 8*c* is determined by the flow rate adjusting valves 32*b* and 32*c* on the basis of their degrees of resistance (opening-degrees). The second medium passes through the third extension pipes 33*b* and 33*c* and enters the indoor units 34*b* and 34*c*. Then, the second medium is subjected to heat exchange with the air in the living room by the indoor unit fans 35*b* and 35*c* and supplies heating energy to the load side, the temperature of the second medium being decreased. The low-temperature second medium further passes through the fourth extension pipes 36*b* and 36*c* and then passes through the second flow path switching valves 37*b* and 37*c*, after which the second medium merges at the second merging path 43 and enters the third heat exchanger 17 again.

In the second cycle 8 to which cooling energy has been supplied from the first cycle 5 through the second heat exchanger 15, the second medium, which is at a low temperature, is circulated by the first pump 21, by which the second medium passes, through the first flow path switching valve 31*a* and enters the branching path 8*a*, The flow rate of the second medium passing through the branching 85 is determined by the flow rate adjusting valve 32*a* on the basis of its degree of resistance (opening-degree). The second medium passes through the third extension pipe 33*a* and enters the indoor unit 34*a*. Then, the second medium is subjected to heat exchange with the air in the living room by the indoor unit fan 35*a* and supplies cooling energy to the bad side, the temperature of the second medium being increased. The high-temperature second medium further passes through the fourth extension pipe 36*a* and then passes through the second flow path switching valve 37*a*, after which the second medium passes through the first merging path 41 and enters the second heat exchanger 15 again.

The controller 100 functions as described below. That is, in this mode as well the controller 100 controls the opening-degrees of the flow rate adjusting valves 32*e* to 32*c* so that the differences in temperatures between the inlets and outlets, each of which is obtained from expression (2) above, become constant.

In this mode as well, the controller 100 controls the rotation speed of the first pump 21 so that the first pressure difference, which is obtained from expression (3) above, becomes constant.

In this mode as well, the controller 100 controls the rotation speed of the second pump 22 so that the second pressure difference, which is obtained from expression (4) above, becomes constant.

Then, the second medium can be appropriately circulated in the indoor units 34*a* to 34*c*.

These operations enable cooling only heating only operation, and combined operation of cooling and heating (Cooling heating simultaneous operation) to be efficiently performed.

Although the opening-degree of the first decompression valve 14 can be adjusted, an on-off valve may be provided in parallel to reduce the pressure loss when the decompression valve is fully open by opening the on-off valve if the decompression valve is fully open and by closing the on-off valve if the decompression valve is not fully open.

The second heat exchanger 15 and third heat exchanger 17 may be plate heat exchangers, double-tube heat exchangers, or microchannel heat exchangers. If there is a restriction on the flow direction in, for example, a plate heat exchanger, however, a selector valve may be provided.

A bridge circuit as shown in FIG. 4 may be provided in either the outdoor unit or the relay unit. Then, even if the four-way valve is switched between the normal direction and the reverse direction during operation, refrigerant noise can be suppressed and thereby the stability of first medium control can be maintained.

The processing capacity of the first heat exchanger 11 can be changed by dividing the first heat exchange in parallel as shown in FIG. 5 and changing the degree of the division, instead of controlling the processing capacity by changing the rotation speed of the outdoor unit fan 12. This method is effective when only one outdoor unit fan 12 is used or the rotation speed of the fan motor must not be lowered in terms of reliability.

Next, an operation for defrosting the first heat exchanger, which is an air heat exchanger, will be described with reference to FIG. 9, according to the flowchart in FIG. 6. When the air conditioning apparatus 1 is started in step S101, initialization is performed in step S102, after which a start occurs in step S103 and steady operation is performed in step S104. Whether defrosting operation is required is determined in step S105. When the first heat exchanger 11 functions as a radiator for the first medium, defrosting operation is not required. When the first heat exchanger 11 functions as an evaporator for the first medium, however, defrosting operation is required and the process thereby proceeds to step S106. In step S106, whether to start defrosting operation is determined on the basis of whether frost has been formed on the surface of the first heat exchanger 11, with reference to the ambient temperature, the heating load, the temperature of the first heat exchanger 11, and a continuous operation time. If it is determined in step S106 that no frost has been formed, a determination as to whether frost has been formed is made again. If it is determined in step S106 that frost has been formed, preparation for defrosting is made in step S107 and defrosting operation is performed in step S108, after which the process returns to step S105.

Next, an operation in preparation for defrosting will be described with reference to FIG. 10, according to the flowchart in FIG. 7. When preparation for defrosting starts in step S110, an it conditioning unit (indoor unit) that has been halted during steady operation is determined in step S111. The following description applies only to the air conditioning unit that has been halted. The indoor unit fan is hafted in step S112, and the applicable flow rate adjusting valve is opened from the fully closed state in step S113. The flow path switching valve is made to communicate with the third cycle 7 in step S114. In step S115, the frequency of the compressor is increased by increasing the target value of the pressure sensor 52 in the first cycle 5. If a prescribed time has elapsed in step S118, the preparation for defrosting is terminated in step S117 and the process proceeds to defrosting operation in step S120. Since it only necessary that the heated second medium reaches the air conditioning unit (indoor unit) that has being halted, third extension pipe, and fourth extension pipe, the opening degree in step S113 and the predetermined time in step S116 do not need to be so lame.

Next, defrosting operation will be described with reference to H according to the flowchart in FIG. 8. When defrosting operation starts in step S120, defrosting operation is performed in the first cycle 5 in step S122. The circuit structure at that time is the same as in cooling operation, When the four-way valve 10 is switched to allow the first medium discharged from the compressor 9 to flow to the first heat exchanger 11, the formed frost is melt and removed. The indoor unit fan should be hafted. During steady operation, the indoor unit is classified as being in heating operation, cooling operation, or halted in step S123. If the indoor unit has been performing heating operation during steady operation, it hafts the indoor unit fan in step S130 and opens the applicable flow rate adjusting valve in step S131. The flow path switching valve is made to communicate with the third cycle 7 in step S132.

If the indoor unit has been performing cooling operation during steady operation in step S123, it performs control still in normal operation in step S140.

If the indoor unit has been halted in step S123, it halts the indoor unit fan in step S150 and opens the applicable flow rate adjusting valve in step S151. The flow path switching valve is made to communicate with the third cycle 7 in step S152.

Upon completion of the operation of each air conditioning unit, whether defrosting has been completed is determined in step S160; specifically, whether the first heat exchanger 11 has been defrosted is determined with reference to the operation time and the temperature of the first heat exchanger 11. If it is determined in step S160 that defrosting has not been completed, a determination as to whether defrosting has been completed is made again. If it is determined in step S160 that defrosting has been completed, the four-way valve 10 is switched in step S161 so as to return the first cycle 5 to the operation mode that was valid before defrosting. During steady operation, the air conditioning unit is classified as being in heating operation, cooling operation, or halted in step S162. That is, if the air conditioning unit has been performing heating operation during steady operation, it has the flow path switching valve communicate with the third cycle 7 in step S171, returns the opening-degree of the flow rate adjusting valve to the opening-degree in temperature difference control in step S172, and operates the indoor unit fan in step S173.

If the air conditioning unit has been performing cooling operation during steady operation in step S162, it performs control still in normal operation in step S180.

If the air conditioning unit has been halted in step S162, it fully closes the flow rate adjusting valve in step S190, halts the indoor unit fan in step S191, and terminates the defrosting operation in step S200, after which the process returns to step S105.

FIGS. 9, 10, and 11 above illustrate a series of these operations. FIG. 9 is for heating-main operation and illustrates a state in which the branching path 8*a* is used for cooling operation, the branching path 8*b* is used for halting, and the branching path 8*c* is used for heating operation. FIG. 10 is for preparation for defrosting and illustrates a state in which the branching path 8*b* is connected to the third cycle, but the indoor unit fan 35*b* is halted, the temperature of the second medium in the branching path 8*b* being increased as it is circulated. FIG. 11 is for defrosting operation and illustrates a state in which the four-way valve is switched, the branching path 8*b* is switched to the second cycle 6, the branching path 8*c* is switched to the third cycle 7, and the second pump is halted.

Since the second medium in the heated branching path 8*b* enters the second heat exchanger 15 in this way, the first medium absorbs heat. Accordingly, the defrosting capacity is increased. Since the second medium in the branching path 8*c* is not circulated, after a return from defrosting operation, a return can be made quickly between steady states.

When the heat source is temporarily stored in the second cycle 6 and third cycle 7, which are heat transfer means, by these operations, the heat source can be used as the defrosting heat source besides electricity supplied to the compressor 9, and the defrosting time can be shortened. Heat generated during defrosting operation not only defrosts the first heat exchanger 11 but also escapes to the outside of the system such as the outside air, the shortened defrosting time enables efficient operation even when the amount of frost is comparable.

REFERENCE SIGNS LIST

1 air conditioning apparatus, 2 heat source unit, 3 relay unit, 4 load unit, 5 first cycle, 6 second cycle, 7 third cycle, 8*a* to 8*c* branching path, 9 compressor, 10 four-way valve, 11 first heat exchanger, 12 outdoor unit fan, 13 first extension pipe, 14 first decompression valve, 15 second heat exchanger, 16 second decompression valve, 17 third heat exchanger, 18 second extension pipe, 19 accumulator, 21 first pump, 22 second pump, 31*a* to 31*c* first flow path switching valve, 32*a* to 32*c* flow rate adjusting valve, 33*a* to 33*c* third extension pipe, 34*a* to 34*c* indoor unit, 35*a* to 35*e* indoor unit fan, 36*a* to 36*c* fourth extension pipe, 37*a* to 37*c* second flow path switching valve, 40 first branching path, 41 first merging path, 42 second branching path, 43 second merging path, 51, 52, 53, 54, 55, 56, 57 pressure sensor, 61, 62, 63, 64, 65, 66, 67*a* to 67*c*, 68*a* to 68*c* temperature sensor, 100 controller

The invention claimed is:

1. An air conditioning apparatus comprising:

a first cycle in which a first medium is circulated;

a second cycle in which a second medium is circulated; and a third cycle, in which the second medium is circulated; wherein:

the first cycle is formed by connecting a compressor, a first heat exchanger constituted by an air heat exchanger, a first decompression valve, a second heat exchanger that exchanges heat between the first cycle and the second cycle, a second decompression valve, a third heat exchanger that exchanges heat between the first cycle and the third cycle, and a four-way valve that switches the flow direction of the first medium between a forward direction and a reverse direction, in that order;

the second cycle is formed by connecting the second heat exchanger, a first pump that drives the second medium, a first branching path that branches a single path into a plurality of paths, indoor units, each of which has a fan, and a first merging path that merges a plurality of paths into a single path, in that order;

the third cycle is formed by connecting the third heat exchanger, a second pump that drives the second medium, a second branching path that branches a single path into a plurality of paths, the indoor units, and a second merging path that merges a plurality of paths into a single path, in that order;

a first flow path switching valve is provided with each path branched by each branching path, the first flow path switching valve being capable of switching a flow path between the second cycle and the third cycle;

a second flow path switching valve is provided with each path merged by each merging path, the second flow path switching valve being capable of switching a flow path between the second cycle and the third cycle;

a pair of the first flow path switching valve and the second flow path switching valve corresponding to each of the indoor units switch to connect the same cycle out of the second cycle and the third cycle; and when the first heat exchanger is defrosted and there is a halted indoor unit, the first flow path switching valve and the second flow path switching valve on the side of a halted indoor unit are switched to the third cycle side and the second pump is driven.

2. The air conditioning apparatus of claim 1, wherein when the first heat exchanger is defrosted, a fan of the indoor unit, for which the switchover to the third cycle side is made and the second pump is driven, is kept halted.

3. The air conditioning apparatus of claim 1, wherein when the first heat exchanger is defrosted, the flow rate adjusting valve for an indoor unit under heating operation is fully closed or the first flow path switching valve and the second flow path switching valve make not to connect with the second cycle or the third cycle in which the second pump is driven.

4. The air conditioning apparatus of claim 1, wherein before the first heat exchanger is defrosted, the halted indoor unit is connected to the third cycle with the fan of the indoor unit under suspension.

5. The air conditioning apparatus of claim 1, wherein before the first heat exchanger is defrosted, a pressure of a first medium in the third heat exchanger is increased.

6. The air conditioning apparatus of claim 1, wherein when the first heat exchanger is defrosted, an indoor unit used for cooling continues to be operated.

7. The air conditioning apparatus of claim 1, wherein when the first heat exchanger is defrosted, a fan of an indoor unit used for heating is halted and the each flow path switching valve makes to connect with the second cycle or the third cycle.

* * * * *